US005435395A

United States Patent [19]

Connell

[11] Patent Number: 5,435,395

[45] Date of Patent: Jul. 25, 1995

[54] METHOD FOR RUNNING DOWNHOLE TOOLS AND DEVICES WITH COILED TUBING

[75] Inventor: Michael L. Connell, Duncan, Okla.

[73] Assignee: Halliburton Company, Duncan, Okla.

[21] Appl. No.: 215,993

[22] Filed: Mar. 22, 1994

[51] Int. Cl.[6] ..... E21B 19/08; E21B 19/22

[52] U.S. Cl. ..... 166/384; 166/65.1; 166/77; 166/385

[58] Field of Search ..... 166/385, 384, 77, 65.1, 166/250

[56] References Cited

U.S. PATENT DOCUMENTS

| | | | |
|---|---|---|---|
| 2,218,955 | 10/1940 | Johnson | 166/77 |
| 2,326,556 | 8/1943 | Opsal . | |
| 2,696,261 | 12/1954 | Ennis | 166/77 |
| 2,798,435 | 7/1957 | Armstrong . | |
| 3,401,749 | 9/1968 | Daniel . | |
| 3,835,929 | 9/1974 | Suman, Jr. | 166/384 |
| 4,062,551 | 12/1977 | Base | 277/102 |
| 4,188,997 | 2/1980 | Ainsworth | 166/77 |
| 4,200,297 | 4/1980 | Tricon | 277/102 |
| 4,224,986 | 9/1980 | Rothberg | 166/117.5 |
| 4,388,969 | 6/1983 | Marshall et al. | 166/242 |
| 4,399,877 | 8/1983 | Jackson et al. | 175/45 |
| 4,442,903 | 4/1984 | Schutt et al. | 166/385 |
| 4,476,923 | 10/1984 | Walling | 166/65.1 |
| 4,506,729 | 3/1985 | Davis, Jr. et al. | 166/65.1 |
| 4,524,834 | 6/1985 | Barron et al. | 166/385 |
| 4,570,709 | 2/1986 | Wittrisch | 166/250 |
| 4,585,066 | 4/1986 | Moore et al. | 166/385 |
| 4,681,162 | 7/1987 | Boyd | 166/242 |
| 4,681,169 | 7/1987 | Brookbank, III | 166/385 |
| 4,685,516 | 8/1987 | Smith et al. | 166/65.1 |
| 4,697,638 | 10/1987 | Knight | 166/65.1 |
| 4,718,486 | 1/1988 | Black | 166/385 X |
| 4,744,245 | 5/1988 | White | 166/250 X |
| 4,844,166 | 7/1989 | Going, III et al. | 166/379 |
| 4,855,820 | 8/1989 | Barbour | 358/100 |
| 4,877,089 | 10/1989 | Burns | 166/65.1 X |
| 4,938,060 | 7/1990 | Sizer et al. | 73/151 |
| 4,976,314 | 12/1990 | Crawford et al | 166/117.5 |
| 4,984,634 | 1/1991 | Pilla | 166/250 |
| 5,180,014 | 1/1993 | Cox | 166/384 |
| 5,202,944 | 4/1993 | Riordan | 385/101 |
| 5,284,210 | 2/1994 | Helsm et al. | 166/385 |

*Primary Examiner*—Hoang C. Dang
*Attorney, Agent, or Firm*—Stephen R. Christian

[57] ABSTRACT

Method of conveying a downhole tool by a coiled tubing unit into a wellbore having a wellhead, and in which the downhole tool is to be communicatively linked to surface equipment by way of an electrical and/or optical cable. The method includes providing a coiled tubing unit, providing a downhole tool that is attachable to the coiled tubing directly, or indirectly attachable to the tubing by way of a provided cablehead, attaching one end of the cable to a cable connector that is in electrical and/or optical communication with the downhole tool, providing and installing a Y-connector to the wellhead of the wellhead of the well bore, the Y-connector having a branch that sealingly accommodates the coiled tubing therethrough, and a branch that sealingly accommodates the cable therethrough. The method further includes tensioning the cable as the cable and the tubing is simultaneously conveyed into and out of the well bore by way of respective branches of the Y-connector.

20 Claims, 3 Drawing Sheets

METHOD FOR RUNNING DOWNHOLE TOOLS AND DEVICES WITH COILED TUBING

BACKGROUND OF THE INVENTION

This invention relates to downhole tools and devices used in oil and gas wells, and more particularly to a method for running downhole tools and devices utilizing coiled continuous tubing into open well bores or well bores having casings.

The use of coiled tubing and coiled tubing equipment to perform many tasks that were conventionally performed by jointed tubular steel piping is well known in the art. Such tasks include the running, or conveying, of downhole well logging tools such as downhole tools having visual and/or acoustic apparatus contained therein by way of coiled tubing, whether it be in vertical, deviated, or horizontal wellbores, or whether the wellbore be open or have casing therein.

Representative prior art patents describing such tasks being performed with coiled tubing include U.S. Pat. No. 4,938,060—Sizer et al., which describes a system and method for visually and/or acoustically inspecting a well bore, and U.S. Pat. No. 5,180,014—Cox, which describes the use of coiled tubing to deploy a submersible electric pump downhole. Both of these patents are specifically incorporated herein as references. Representative prior patents disclosing the use of conventional jointed tubing and coiled continuous tubing specifically for performing logging operations include U.S. Pat. Nos.: 4,685,516—Smith et al.; 4,570,709—Wittrisch; and 3,401,749—Daniel, all of which are also specifically incorporated herein as references.

A shortcoming with the prior art, especially when using conventional jointed tubing for running tools downhole, is the inherent difficulty in running tools downhole in wells that have a relatively high wellhead pressure because means must be provided about the jointed tubing to maintain pressure differentials between the wellbore near the surface and the atmosphere. Thus, there remains a need for a method which allows tools to be run downhole in a convenient manner when the subject well has relatively high pressures at or near the surface where the wellhead is normally located. Such pressures may exceed 2,500 psi (17.3 MPa) and in the past, the well was "killed" or other steps were taken to temporarily reduce the high surface pressures in order for tools to be safely run into that portion of the well of particular interest.

Another shortcoming with the prior art resides in the fact that coiled tubing units used for well logging and/or visual/acoustical inspection have an electrical or an opto-electrical cable installed within a preselected size and length of the coiled tubing that is stored on a reel. Such cables routinely contain electrical leads for powering the tool or device installed on the coiled tubing, and/or contain optical or communication leads for carrying signals generated by the downhole tool, or device, to recordation and monitoring equipment located on the surface. Additionally, the cable may contain electrical control leads, or conductors, which are needed to operate and control various functions and components within the downhole tool or device. Such leads may be of conventional multi-stranded metal conductor wire surrounded by an insulative jacket, or of conventional coaxial cable. Furthermore, the use of fiber-optic glass or plastic leads having various protective shrouds, also referred to as fiber-optic cable are being employed in such downhole cables that are capable of withstanding high pressures. Because the downhole cable, regardless of the type or combination of leads contained therein, is as a practical matter, permanently installed in a given coil of tubing installed in a coiled tubing unit due to the coil of tubing often times can not be removed and replaced in field locations due to the size and weight of the reeled tubing. This results in coiled tubing units being specifically limited to, or dedicated, to operations that can utilize, or at least not be hindered by, the particular electrical or opto-electrical cable that is installed therein. For example, a coiled tubing unit having such a cable installed therein would not be as effective, or perhaps not usable, when used for treatment or stimulation operations because of the obstructing nature of the cable being present within the tubing. The requirement that dedicated coiled tubing units be acquired and maintained results in an economical disadvantage to coiled tubing operators, especially in geographically large or remote areas where such coiled tubing units having an appropriate cable therein are in very limited supply. In such situations, logging and/or inspection jobs must be anticipated and planned several days or weeks in advance to allow for transportation of the required coiled tubing unit having an appropriate cable therein.

SUMMARY OF THE INVENTION

According to the present invention a method of conveying a downhole tool, or device, by a coiled tubing unit into a wellbore having a wellhead, and in which the downhole tool is to be communicatively linked to surface equipment by way of an electrical and/or optical cable is provided. The method includes providing a coiled tubing unit having a supply of coiled tubing and means for injecting and extracting the tubing into and out of the wellbore. The method further includes providing a downhole tool that is attachable to the coiled tubing directly or is indirectly attachable to the tubing by way of a provided cable head means. The method further includes providing a preselected length of cable having means for conducting electrical signals, optical signals, or a combination thereof. The method also includes attaching one end of the cable to surface equipment and attaching one end of the cable to a cable connector that is in electrical and/or optical communication with the downhole tool. The method additionally includes providing and installing a Y-connector to the wellhead of the wellbore, the Y-connector having one branch having means for sealingly accommodating the coiled tubing therethrough, and one branch having means for sealingly accommodating the cable therethrough. Lastly, the method includes providing means for appropriately tensioning the cable as the cable and the tubing is simultaneously conveyed into, or out of, the wellbore through respective branches of the Y-connector.

DETAILED DESCRIPTION OF THE PREFERRED METHOD

Figure 1:
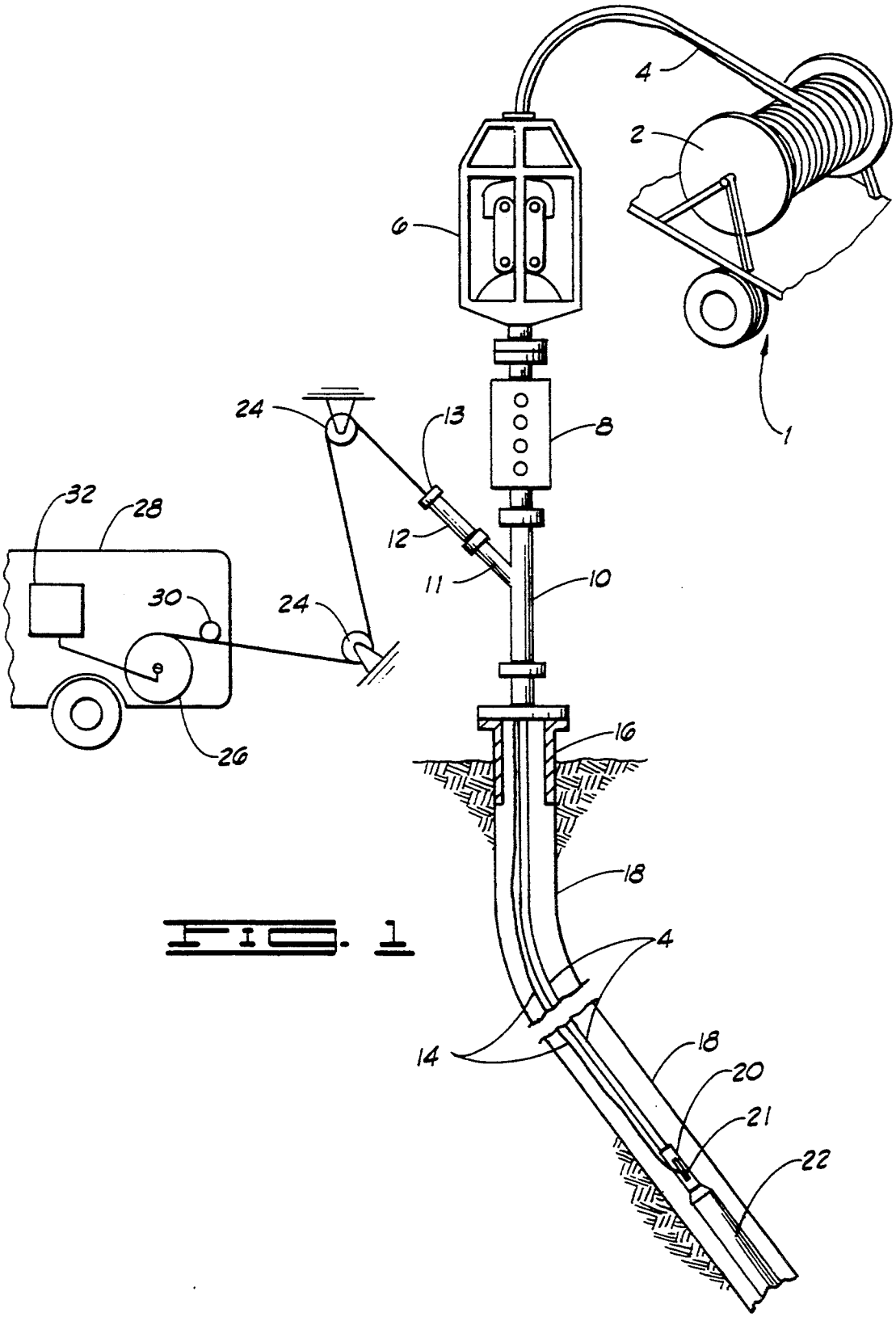
FIG. 1 of the drawings is a simplified elevational view, partly in section, showing surface and downhole equipment and operational layout utilizing a conventional coiled tubing unit to perform the method of the present invention.
Figure 2:
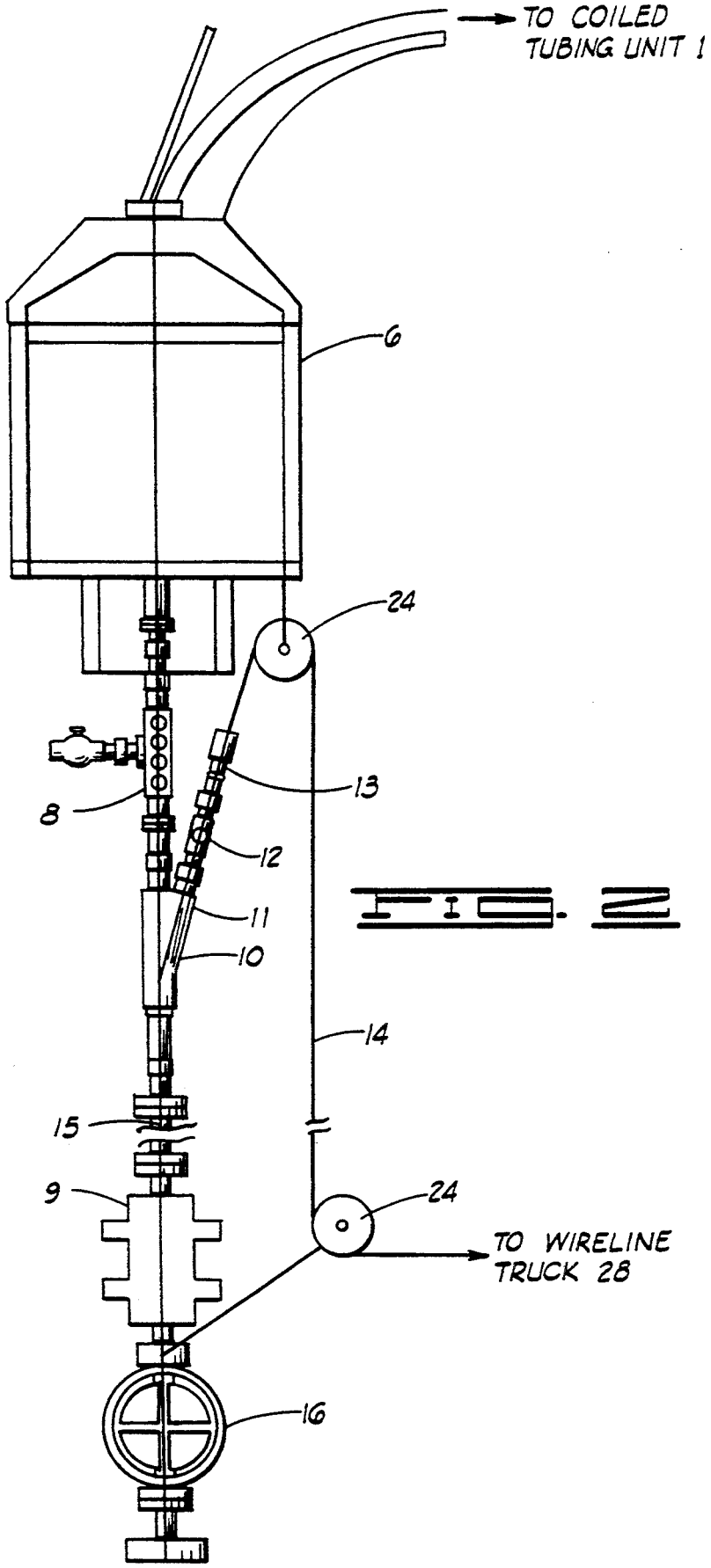
FIG. 2 of the drawings is a front view of a representative surface equipment "stack" installed upon a wellhead suitable for practicing the method of the present invention.

Referring now to FIG. 1 of the drawings, which schematically depicts a coiled tubing unit 1 having a coiled reel 2 having a preselected size and length of coiled tubing 4 installed thereabout which is typical of coiled tubing units well known within the art. Tubing 4 is shown being injected by tubing injector 6 which is also well known within the art. Tubing injector 6 is shown attached to a blow out preventor (BOP) 8 which is preferably specifically designed for coiled tubing operations. A suitable BOP 8 for practicing the present invention is available from Texas Oil Tools in a variety of models. Tubing 4 then passes vertically through BOP 8 and into and through the vertically oriented segment of Y-connector 10 that is installed between BOP 8 and a conventional wellhead 16. FIG. 2 of the drawings shows an equipment stack having a second BOP 9 having blind and cutter rams therein and being installed upon wellhead 16 and a spool spacer 15 being installed between BOP 9 and Y-connector 10. Either of the surface equipment stacks shown in FIGS. 1 and 2 are suitable for practicing the disclosed method. Furthermore, wellhead 16, or the stack itself, may have a variety of components including lubricators and valves that have not been shown schematically in the drawings but if properly selected will not hinder the practicing of the disclosed method.

Referring now to both FIGS. 1 and 2, Y-connector 10 has a conventional hydraulic packoff, or grease head, 13 to act as a cable seal that is particularly suitable for receiving and allowing a preselected electrical, optical, or opto-electrical cable 14 to pass therethrough while retaining any pressure differential that may be present at or near the surface of the wellbore. Such seals are well known in the art because they are typically used in the running of wirelines downhole. A valve 12 is installed between seal 13 and member 11 which serves to seal around the cable when the cable is stationary in order to service equipment located above the valve. One such Y-connector 10 particularly suitable for practicing the present invention is a top entry sub described in U.S. Pat. No. 5,284,210—Helms et al., and is commercially available from Specialty Tools. It is suggested that any internal surfaces in which the cable may come into contact be smoothed by grinding and or polishing so as not to unduly abrade a cable 14 traveling within the Y-connector.

As mentioned there are many suitable grease heads or seals 13 which are known and readily adaptable to Y-connector 10 which are commercially available from such companies as Bowen or Hydrolex.

Likewise, there are many suitable valves 12 which are known and readily adaptable to seal 13 and angled member 11 of Y-connector 10 which are commercially available from such companies as Bowen or Hydrolex.

Referring now to FIG. 1, well head 16, tubing 4 and cable 14 are shown passing through wellhead 16 and into well bore or casing 18. Well bore 18 is shown as being deviated, however, well bore 18 may be vertical, or horizontal, or of any particular configuration or orientation that will accommodate and allow tubing and cable to be run therein. Although the operational layout in FIG. 1 is simplified, it depicts components nominally needed to perform the disclosed method. The depicted components include cablehead 20 being removably attachable to the free end of tubing 4 and is preferably provided with a cable connector, or side connector, 21, that allows at least one electrical, opto, or opto-electrical cable 14 to be connected directly a preselected downhole tool, or device 22. Alternatively, cable 14 is connected to matching terminals or leads extending to a preselected downhole tool, or device, 22. Such downhole tools, or devices include logging tools adapted for conveyance by coiled tubing, such as real-time downhole video, visual, acoustic logging and/or inspection tools and devices. Regardless of which specific tool, or device, is selected, it is preferable to removably attach the downhole tool to a cablehead 20, or if practical, directly to tubing 4.

Electro-opto, or opto-electrical, or electrical cable 14 may have only one wire, or lead, of a single conductor, or it may have a multi-conductor lead, or it may contain one or more conventional coaxial cables, or it may have a fiber optical lead made of glass or plastic, or it may have several leads of various combinations that are needed to operate and provide information regarding downhole tool 22. Preferably cable 14 has a sheath to protect the various leads that form cable 14. A representative downhole video well-logging tool having an opto-electrical cable is disclosed in U.S. Pat. No. 5,505,944 —Riordan, assigned to Westech Geophysical, Inc., Ventura, Calif. Furthermore, any common logging cable is suitable for practicing the present invention.

A cable connector slot 21 preferably positioned on the side of cablehead 20, as shown in FIG. 1, serves as a convenient connection, or entry point, to attach or route the cable to complete any electrical and/or optical connections needed between the cable and the downhole tool for communication, control, or command functions.

It will be understood within the art that cablehead 20, in its most general sense, may include many components known as subs, valves, and disconnects that are helpful, if not essential, in running and operating a downhole tool via coiled tubing.

Figure 3:
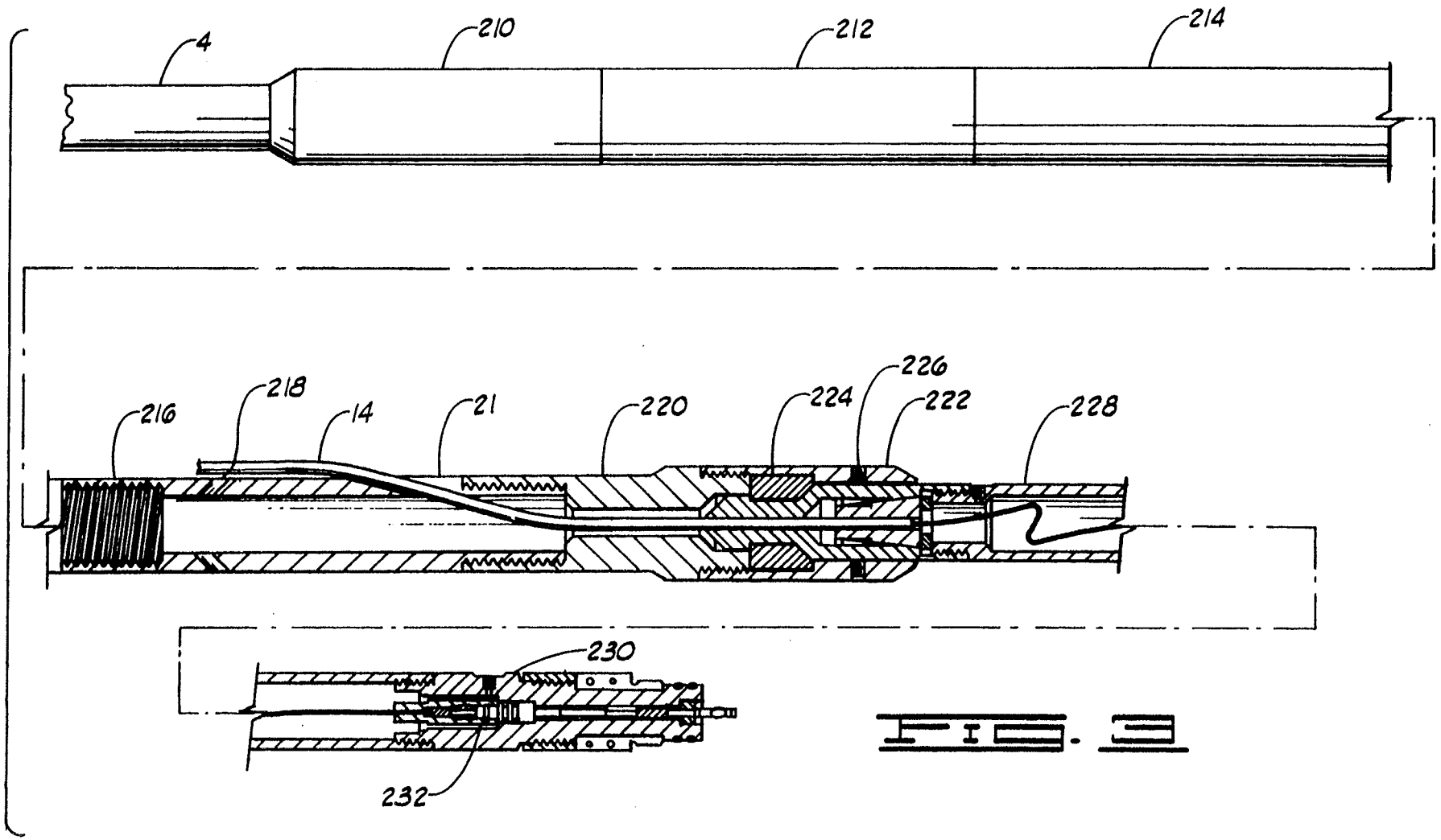
FIG. 3 of the drawings is a more detailed cross-sectional view of a portion of the tubing and associated downhole equipment "build-up" suitable for performing the method of the present invention.

Therefore, FIG. 3 has been provided to illustrate a more sophisticated cablehead encompassing a build-up of such components installed in-line upon the end of the coiled tubing to allow better operation of a selected downhole tool that would then be installed at the end of the components previously installed thereon.

The downhole cablehead component build-up shown in FIG. 3 will be discussed sequentially beginning with tubing 4 and terminating at the free end where a selected downhole tool 22 (not shown in FIG. 3) would be attached. Tubing 4 is coupled to coiled tubing connector 210 which in turn is coupled to check valve 212 which in turn is coupled to disconnect joint 214. Disconnect joint 214 is coupled to a top sub 216 which preferably has a plurality of circulation ports 218 and a cable slot, or side connector 21, which receives cable 14 therein. A middle sub 220 is coupled to top sub 216 and further accommodates cable 14 therein. A split-sleeve capture sub 222 is coupled to middle sub 220 to provide a means of clamping cable 228 onto the tubing by way of split retainers 224 and other associated components. Holes 226 accommodate set screws therein for preventing rotation of internal components of the capture sub.

A standard cablehead 228 is coupled to capture sub 222, which also further accommodates cable 14, or electrical and/or optical conductors thereof. Cablehead 228 is coupled to a rotating contact sub 230 which is then connected with a selected downhole tool. Rotating contact sub 230 has provisions for maintaining a communicative link with the selected downhole tool and the leads or conductors of cable 14. The various subs and cablehead illustrated and discussed in the above layout are known and commercially available within the art. It will also be apparent to those skilled in the art the layout in FIG. 3 is exemplary and that components could be added or subtracted therefrom, as well as be modified as operations require.

Returning now to FIG. 1 to that portion of cable 14 located at the surface and that has yet to be run into, or has been extracted from well bore 18. Cable 14 is stored upon, and decoiled from, and recoiled upon spool 26 located within a logging vehicle, trailer, or skid 28. Vehicle 28 preferably has the necessary equipment 32 to command or control a preselected downhole tool 22 as well as to provide communication means for monitoring, displaying, and recording data generated by preselected tool 22 as it is being operated within well bore 18. Cable 14 is linked to equipment 32 by appropriate means known within the art. Vehicle 28 may also provide communication/control links to such equipment that may be remotely located. Logging vehicle 28 is preferably equipped with depth measurement device 30 to provide information as to the amount of cable 14 that has been run into well bore 18. Measurement device 28 may also provide information as to the rate that cable 14 is being pulled into or out of well bore 18 if so desired. Cable 14 is preferably supported by sheaves 24, that are fixed to stationary objects conveniently available at the well site, in order to guide and provide means of controlling slack that may develop in the cable as it is going into or out of the well bore. Preferably the cable is kept under a preselected amount of tension appropriate for maintaining the cable taut, yet free enough, to travel in concert with the tubing in the desired direction via spool 26 or associated equipment.

Preferably, the method of the disclosed invention includes conveying a downhole tool, or device 22, into a well bore 18 having a wellhead 16 via coiled tubing unit 1 having tubing 4 spooled about a reel 2 and further includes providing tubing 4 of a sufficient diameter and length for the job to be run. The method also includes providing an injector head 6 of sufficient capacity for injecting and extracting tubing 4 into and out of the wellbore 18. A Y-connector 10 that can accommodate the passing of the selected tubing 4 therethrough is provided and Y-connector 10 is positioned between tubing injector 6 and wellhead 16, which may include a lubricator and other components commonly used within the art. Preferably BOP 8 is positioned between and in fluid communication with the provided Y-connection and tubing injector however, BOP 8 may be placed in other positions and/or a second BOP 9 may be placed between wellhead 16 and Y-connector 10. The provided Y-connector is sized and configured to be provided with means for guiding and means for providing a seal about the exterior of at least one cable 14 having opto-electrical leads, electrical leads, optical leads, or a combination thereof into the well bore simultaneously, or in concert with, but external to the tubing as the tubing is being injected into or extracted out of the wellbore. The preferred method further includes maintaining appropriate tension on the cable by way of a powered cable reel 26 located on a vehicle, trailer, or skid 28 and optional sheaves 24 while Y-connector 10 with seal 13 maintains any pressure differential that may exist between the atmosphere and the well bore at or near the surface when actually deploying tools into and out of the wellbore. The method further includes providing and installing a preselected tool 22 and preferably a cable head 20, in the form of a single component or a collection of preselected components, to the free end of the coiled tubing and attaching the remaining end of the cable to or into the cable head by way of a connector or port 21 located on the side thereof which is in electrical and/or optical communication with preselected tool 22 that has been previously attached to the cable head. Preferably, the free end of coiled tubing 4 will have a connector, a check valve, a disconnect, a top sub that accommodates cable 4 thereinto by a port or side connector 21, a middle sub, a split sleeve capture sub, a cable head per se, and a rotating contact sub suitable for being removably attachable to a selected downhole tool 22 and having means for communicatively linking any conductors of cable 4, whether the conductors are for conducting electrical signals or optical signals, or both, with the selected downhole tool to be installed on the rotating contact sub. Conversely, if a particular operation employing the disclosed method allows it, downhole tool 22 could be provided with an integral cablehead 20 having an integral connector 21 fashioned to accommodate cable 14 and to provide a communicative link to downhole tool 22.

By use of the above disclosed method, it is technically possible and economically attractive to run a preselected downhole tool into a pressurized wellbore with readily available coiled tubing units not having cables installed within the tubing thereby limiting or even precluding their usefulness for other tasks.

While the preferred method of the present invention has been disclosed and described, it will be apparent to those skilled in the art that alterations and modifications can be made without departing from the spirit and scope of the appended claims.

I claim:

1. A method of conveying a downhole tool by a coiled tubing unit into a well bore having a wellhead, and in which the downhole tool is to be communicatively linked to surface equipment by way of an opto-electrical cable, the method comprising:

a) providing a coiled tubing unit having a supply of coiled tubing and means for forcefully injecting and extracting the tubing into and out of the well bore;

b) providing a downhole tool and means for attaching the downhole tool to the coiled tubing directly or indirectly to the tubing;

c) providing at least one preselected length of cable having means for conducting electrical and optical signals;

d) linking one end of the cable to surface equipment and linking one end of the cable to the downhole tool or to a cable connector that is in electrical and optical communication with the downhole tool to provide an operational link between the downhole tool and the surface equipment;

e) providing and fluidly connecting a Y-connector to the wellhead of the well bore, the Y-connector having a branch having means for sealingly accommodating the coiled tubing therethrough, and a branch having means for sealingly accommodating the cable therethrough; and f) providing means for appropriately tensioning the cable as the cable and the tubing is simultaneously conveyed into, or out of, the well bore by way of the Y-connector when operating the coiled tubing unit accordingly.

2. The method of claim 1 wherein the cable remains external of the coiled tubing.

3. A method of conveying a well logging tool by a coiled tubing unit into a well bore having a wellhead, and in which the well logging tool is to be communicatively linked to surface equipment by way of an electrical cable, or optical cable, or a combined opto-electrical cable, the method comprising:

a) providing a coiled tubing unit having a supply of coiled tubing and means for forcefully injecting and extracting the tubing into and out of the well bore;

b) providing a well logging tool and means for attaching the well logging tool to the coiled tubing directly or indirectly to the tubing;

c) providing at least one preselected length of cable having means for conducting electrical signals, optical signals, or a combination thereof;

d) linking one end of the cable to surface equipment and linking one end of the cable to the downhole logging tool or to a cable connector that is in electrical and/or optical communication with the downhole logging tool and the surface equipment;

e) providing and fluidly connecting a Y-connector to the wellhead of the well bore, the Y-connector having a branch having means for sealingly accommodating the coiled tubing therethrough, and a branch having means for sealingly accommodating the cable therethrough; and f) providing means for appropriately tensioning the cable as the cable and the tubing is simultaneously conveyed into, or out of, the well bore by way of the Y-connector when operating the coiled tubing unit accordingly.

4. The method of claim 3 further comprising installing at least one blow-out-preventor means in line between the tubing injecting and extracting means and the wellhead.

5. The method of claim 3 wherein the wellbore is deviated from vertical, horizontal, or a combination thereof.

6. The method of claim 3 wherein the surface equipment in which the downhole tool is linked by the cable is mounted in a vehicle, a skid, a platform, or a combination thereof.

7. The method of claim 3 wherein the cable tensioning means comprises: providing a supply of cable on a powered reel, providing means for tensioning the cable as the tubing and the cable are run simultaneously into and out of the wellbore, and providing means of measuring the length of cable that has been run into the wellbore.

8. The method of claim 3 further comprising installing a grease seal means and a valve on the branch of the Y-connector that sealingly accommodates the cable therethrough.

9. The method of claim 3 further comprising installing a detachable cablehead between the tubing and the downhole tool, the cablehead having a cable connector thereon in which one end of the cable is removably attached thereto to complete a communicative link to the downhole tool.

10. The method of claim 3 further comprising installing between one end of the coiled tubing and the downhole tool at least one of the following components that may be coupled to provide a means of attaching the downhole tool to the coiled tubing and to provide a means of providing a communicative link between the cable and the downhole tool: a removable tubing connector, a removable tubing check valve, a removable tubing disconnect, a removable top sub having an access slot for accommodating a portion of the cable, a removable middle sub, a removable split sleeve capture sub, a removable cablehead, or a rotating contact sub having means to provide a communicative, control, and command link between the cable and the downhole tool.

11. The method of claim 3 wherein the cable remains external of the coiled tubing.

12. A method of conveying a downhole tool containing a video camera by a coiled tubing unit into a well bore having a wellhead, and in which the downhole tool is to be a communicatively linked to surface equipment by way of an electrical cable, or optical cable, or a combined opto-electrical cable so that the video camera, in connection with the surface equipment, provides video images of the well bore that are viewable in real time, the method comprising:

a) providing a coiled tubing unit having a supply of coiled tubing and means for forcefully injecting and extracting the tubing into and out of the well bore;

b) providing a downhole tool containing a video camera and means for attaching the downhole tool to the coiled tubing directly or indirectly to the tubing;

c) providing at least one preselected length of cable having means for conducting electrical signals, optical signals, or a combination thereof;

d) linking one end of the cable to surface equipment and linking one end of the cable to the downhole tool or to a cable connector that is in electrical and/or optical communication with the downhole tool and the surface equipment;

e) providing and fluidly connecting a Y-connector to the wellhead of the well bore, the Y-connector having a branch having means for sealingly accommodating the coiled tubing therethrough, and a branch having means for sealingly accommodating the cable therethrough; and f) providing means for appropriately tensioning the cable as the cable and the tubing is simultaneously conveyed into, or out of, the well bore by way of the Y-connector when operating the coiled tubing unit accordingly.

13. The method of claim 12 wherein the cable remains external of the coiled tubing.

14. The method of claim 12 further comprising installing at least one blow-out-preventor means in-line between the tubing injecting and extracting means and the wellhead.

15. The method of claim 12, wherein the well bore is deviated from vertical, horizontal, or a combination thereof.

16. The method of claim 12, wherein the surface equipment in which the downhole tool is linked by the cable is mounted in a vehicle, skid, a platform, or a combination thereof.

17. The method of claim 12 wherein the cable tensioning means comprises: providing a supply of cable on a powered reel, providing means for tensioning the cable as the tubing and the cable are run simultaneously into and out of the wellbore, and providing means of measuring the length of cable has been run into well bore.

18. The method of claim 12 further comprising installing a grease seal means and a valve on the branch of the Y-connector that sealingly accommodates the cable therethrough.

19. The method of claim 12 further comprising a detachable cablehead between the tubing and the downhole tool, the cablehead having a cable connector thereon in which one end of the cable is removably attached thereto to complete a communicative link to the downhole tool.

20. The method of claim 12 further comprising installing between one end of the coiled tubing and the downhole tool at least one of the following components that may be coupled to provide a means of attaching the downhole tool to the coiled tubing and to provide a means of providing a communicative link between the cable and the downhole tool: a removable tubing connector, a removable tubing check valve, a removable tubing disconnect, a removable top sub having an access slot for accommodating a portion of the cable, a removable middle sub, a removable split sleeve capture sub, a removable cablehead, or a rotating contact sub having means to provide a communicative, control, and command link between the cable and the downhole tool.

* * * * *